US010486014B1

(12) United States Patent
Trotter, Jr.

(10) Patent No.: US 10,486,014 B1
(45) Date of Patent: Nov. 26, 2019

(54) EXERCISE APPARATUS

(71) Applicant: Ray Edward Trotter, Jr., Wichita, KS (US)

(72) Inventor: Ray Edward Trotter, Jr., Wichita, KS (US)

( * ) Notice: Subject to any disclaimer, the term of this patent is extended or adjusted under 35 U.S.C. 154(b) by 231 days.

(21) Appl. No.: 15/462,430

(22) Filed: Mar. 17, 2017

Related U.S. Application Data

(60) Provisional application No. 62/310,505, filed on Mar. 18, 2016.

(51) Int. Cl.
*A63B 21/00* (2006.01)

(52) U.S. Cl.
CPC ..... *A63B 21/4035* (2015.10); *A63B 21/4027* (2015.10); *A63B 21/4034* (2015.10); *A63B 2210/50* (2013.01)

(58) Field of Classification Search
CPC ..... A63B 21/00047; A63B 21/00185; A63B 21/068; A63B 21/08; A63B 21/15; A63B 21/159; A63B 21/16; A63B 21/4011; A63B 21/4013; A63B 21/4015; A63B 21/4023; A63B 21/4025; A63B 21/4027; A63B 21/4029; A63B 21/4033; A63B 21/4034; A63B 21/4035; A63B 21/4039; A63B 21/4041; A63B 21/4047; A63B 21/4049; A63B 23/02; A63B 23/0205; A63B 23/0211; A63B 23/0216; A63B 23/0222; A63B 23/0233; A63B 23/0238; A63B 23/12; A63B 23/1209; A63B 23/1227; A63B 23/1236; A63B 23/1245; A63B 69/0057; A63B 69/0064; A63B 2069/0062; A63B 71/0036; A63B 2208/0228; A63B 2208/0233; A63B 2208/0295; A63B 2210/00; A63B 2210/50; A63B 2225/09; A63B 2225/093; A63B 2225/10
See application file for complete search history.

(56) References Cited

U.S. PATENT DOCUMENTS 3,446,503 A * 5/1969 Lawton ..... A63B 21/068 482/96
4,674,160 A * 6/1987 Gibson ..... A63B 21/06 482/139
5,082,259 A * 1/1992 Gonzalez ..... A63B 23/0355 482/104
5,743,832 A * 4/1998 Sands ..... A63B 22/001 482/112
5,810,702 A * 9/1998 Wilkinson ..... A63B 21/00047 482/130
5,899,836 A * 5/1999 Chen ..... A63B 21/0552 482/130

(Continued)

*Primary Examiner* — Gary D Urbiel Goldner
(74) *Attorney, Agent, or Firm* — Robert O. Blinn

(57) ABSTRACT

An exercise apparatus includes a base, a handlebar and handles. The handlebar presents opposite laterally extending handle support portions that have regular polygonal cross sections. Each handle includes a mounting portion that presents a corresponding regular polygonal opening that is adapted to slidably and adjustably receive one of the handle support portions. Each of the handles are able to be secured to one of the handle support portions in a range of locations between an inboard location and an outboard location and each of the handles is also able to be secured to one of the handle support portions in one of at least two angular orientations.

5 Claims, 10 Drawing Sheets

(56) References Cited

U.S. PATENT DOCUMENTS

| | | | | |
|---|---|---|---|---|
| 6,626,808 | B1 | 9/2003 | Adams | |
| 6,855,098 | B2 | 2/2005 | Reitz et al. | |
| 7,004,894 | B1 * | 2/2006 | Trotter | A63B 23/02 482/140 |
| 7,654,944 | B1 * | 2/2010 | Liu | A63B 21/078 482/140 |
| 7,703,845 | B2 | 4/2010 | Smith et al. | |
| 9,044,629 | B2 | 6/2015 | Ross et al. | |
| 2001/0018387 | A1 * | 8/2001 | Webber | A63B 21/078 482/142 |
| 2003/0114281 | A1 * | 6/2003 | Mackert | A63B 21/00 482/123 |
| 2003/0134730 | A1 * | 7/2003 | Deola | A63B 21/02 482/130 |
| 2006/0122045 | A1 * | 6/2006 | Webber | A63B 21/4029 482/142 |
| 2008/0287269 | A1 * | 11/2008 | Humble | A63B 21/153 482/92 |
| 2009/0197746 | A1 * | 8/2009 | Splane, Jr. | A63B 21/02 482/121 |
| 2010/0022368 | A1 * | 1/2010 | Fernandez | A63B 21/055 482/140 |
| 2015/0375036 | A1 * | 12/2015 | Ho | A63B 23/0222 482/140 |
| 2017/0225029 | A1 * | 8/2017 | Lin | A63B 21/159 |

* cited by examiner

EXERCISE APPARATUS

CROSS REFERENCES TO RELATED APPLICATIONS

This application claims the benefit of U.S. Provisional Patent Application 62/310,505 filed on Mar. 18, 2016 which is incorporated herein by reference.

FIELD OF THE INVENTION

This invention relates to an exercise apparatus which accommodates a plurality of exercises.

BACKGROUND

A number of specific exercise apparatuses have been devised to accommodate a particular exercise. In many cases a specific exercise apparatus will be a large bulky piece of equipment which is adapted to accommodating an exerciser who is performing one particular exercise. Particularly for home use, what is needed is a small compact exercise apparatus which may be easily reconfigured in order to facilitate a number of exercises for exercisers having a range of body sizes.

SUMMARY

In an embodiment of the present invention, the aforementioned needs are addressed by an exercise apparatus which includes a base, a seat, a handlebar and a pair of handles. In one embodiment, the base is a strong, stable compact structure that is arranged to support a seat which is suitable for supporting an exerciser. The handlebar is fixed in relation to the base and is preferably adjacent to the seat. The handlebar presents two opposite handle support portions. The handle support portions present cross sections which are preferably identical and have the shape of a regular polygon. Each handle includes a mounting portion and handle portion. The handle portion of each handle is suitable for grasping by the human hand. The mounting portion of each handle presents an opening in the shape of the regular polygon that is adapted to receive the regular polygon shaped handle support portions at the outboard ends of the handlebar. Each of the handles are able to be secured to one of the handle support portions in a range of locations between an inboard location and an outboard location. Each of the handles are also able to be secured to one of the handle support portions in one of at least two angular orientations including at least a level position and an upright position. Accordingly, an exerciser may adjust the spacing between the handles and set up the orientations of the handles so as to accommodate the shoulder width of the exerciser and to so as to facilitate one of a plurality of exercises.

DETAILED DESCRIPTION

Figure 1:
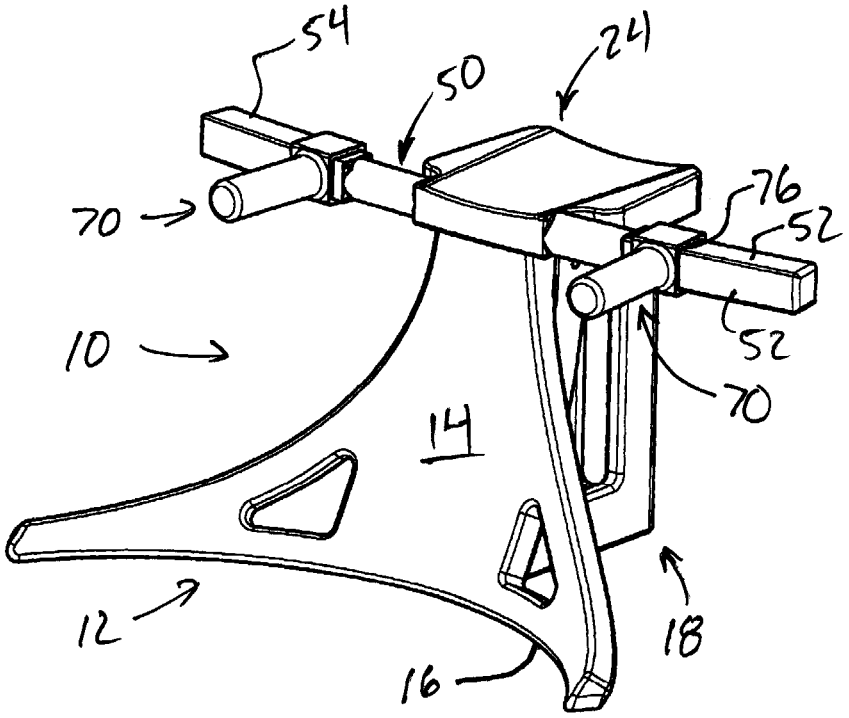
FIG. 1 is a perspective view of one embodiment of the exercise apparatus.

Referring to the drawings, FIG. 1 illustrates an exercise apparatus 10 which is a first embodiment of the exercise apparatus. Exercise apparatus 10 includes a base 12, a seat rest 24, a handlebar 50 and first and second handles 70. As can be seen in FIGS. 1-5, in this example, base 12 supports seat rest 24. In this example, handlebar 50 extends through the front portion of seat rest 24 and presents two opposite handle support portions 52 and 54 which extend laterally on opposite sides of seat rest 24. Handle support portions 52 and 54 receive handles 70 which will be described in greater detail below.

Figure 2:
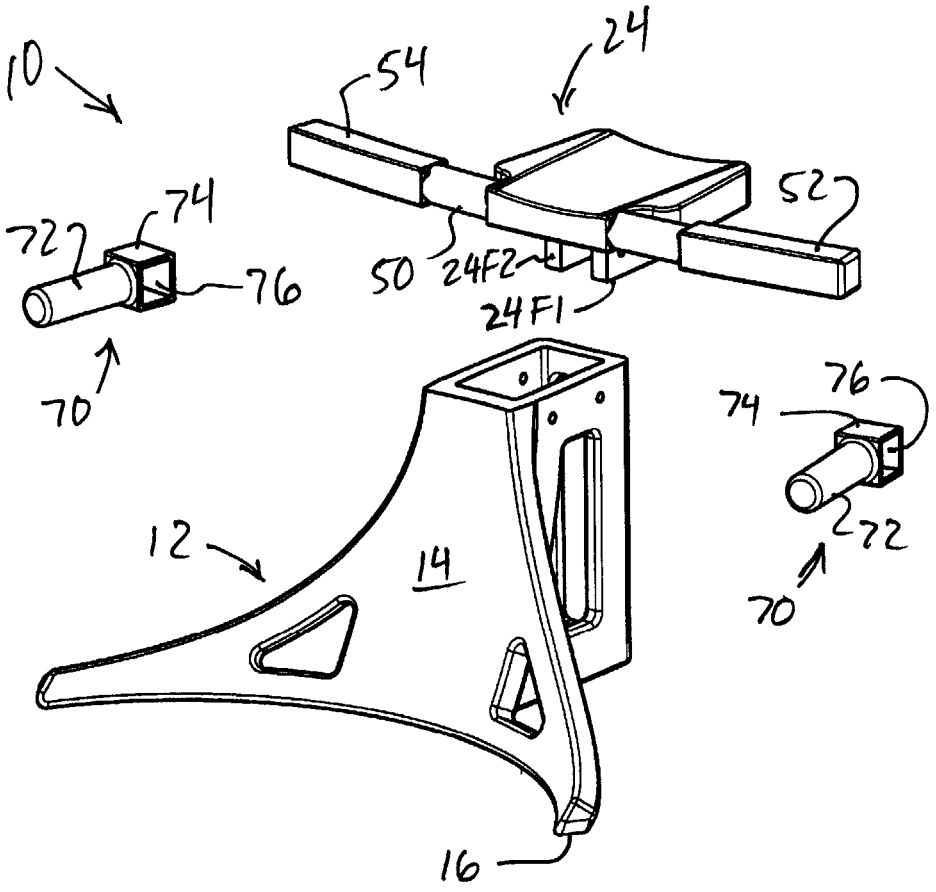
FIG. 2 is a first exploded perspective view of the one embodiment of the exercise apparatus.
Figure 3:
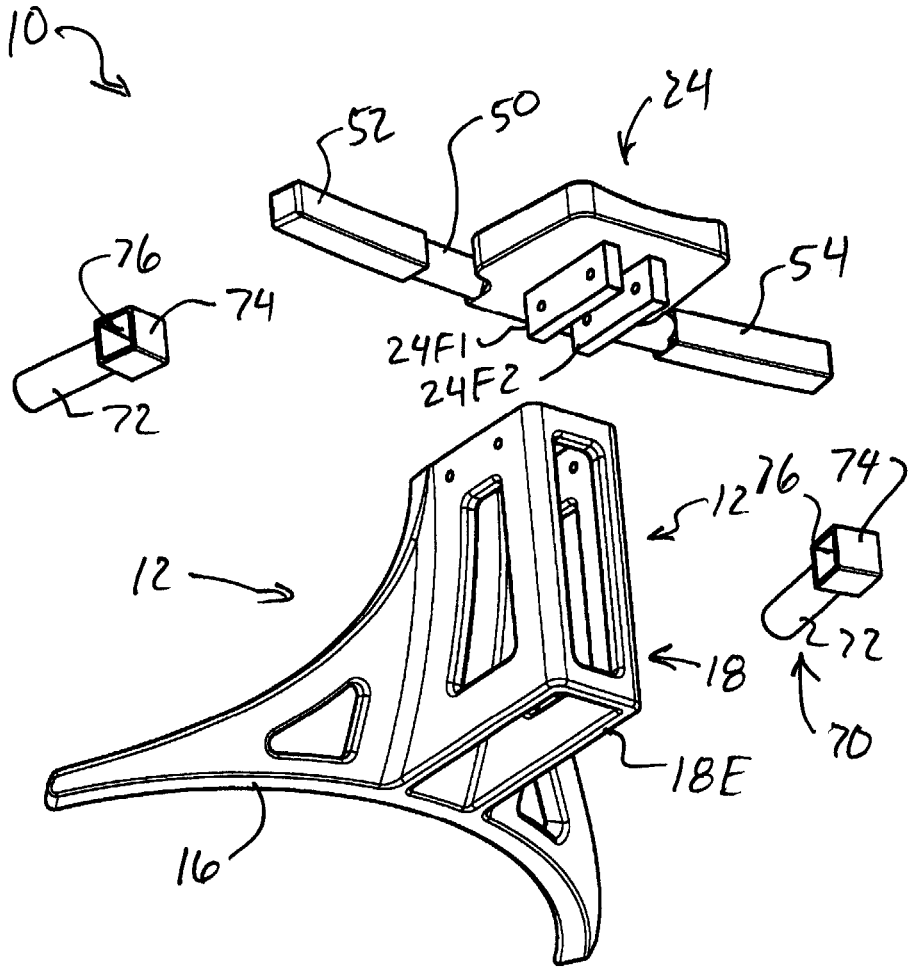
FIG. 3 is a second exploded perspective view of the one embodiment of the exercise apparatus.

As can be seen in FIGS. 1-5, base 12 includes a forward curved plate 14. Forward curved plate 14 has a unique dish like curvature and is bounded at its lower end by a flat but curved lower edge 16 which is adapted for lying flat on a floor. Base 12 further includes a box structure 18 which is fixed to back surface of curved plate 14. As is shown in FIG. 3, box structure 18 also has lower edges 18E which are flat and co-planer with lower edge 16 of curved plate 12. Accordingly, lower edges 18E are arranged to engage the same floor surface as edge 16 of curved plate 12. Seat rest 24 is mounted to the top ends of curved plate 12 and box portion 18. As can be seen in FIGS. 2 and 3, which are exploded perspective views of apparatus 10, seat rest 24, in this example, presents flanges 24F1 and 24F2 depending from its lower surface. Flanges 24F1 and 24F2 present fastener holes which correspond to co-aligned fastener holes near the upper edges of box portion 18. Those skilled in the art will readily appreciate that pins or fasteners of the like could be employed to secure seat rest 24 to base 12.

Figure 4:
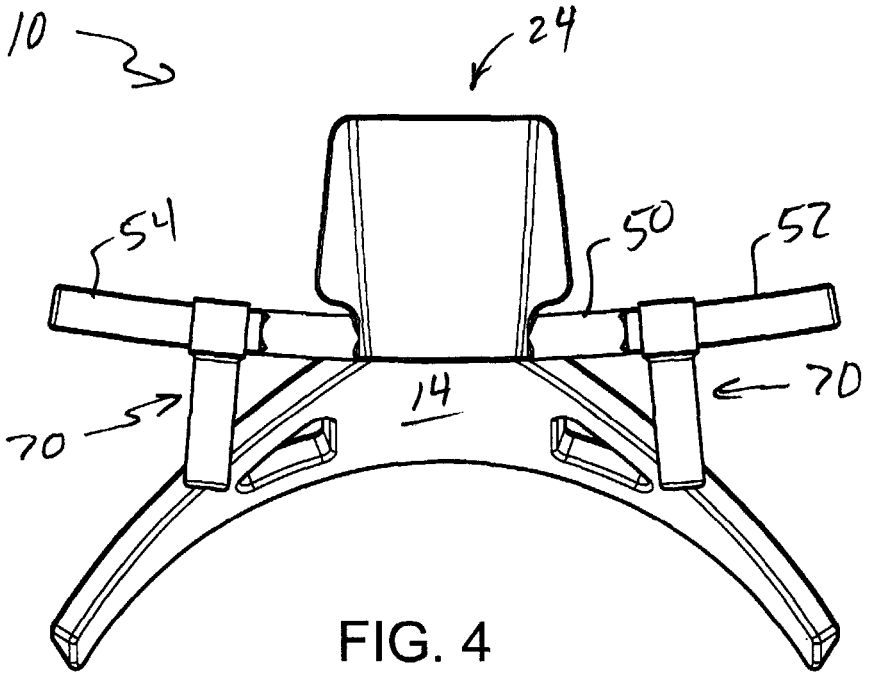
FIG. 4 is a top view of the one embodiment of the exercise apparatus.
Figure 5:
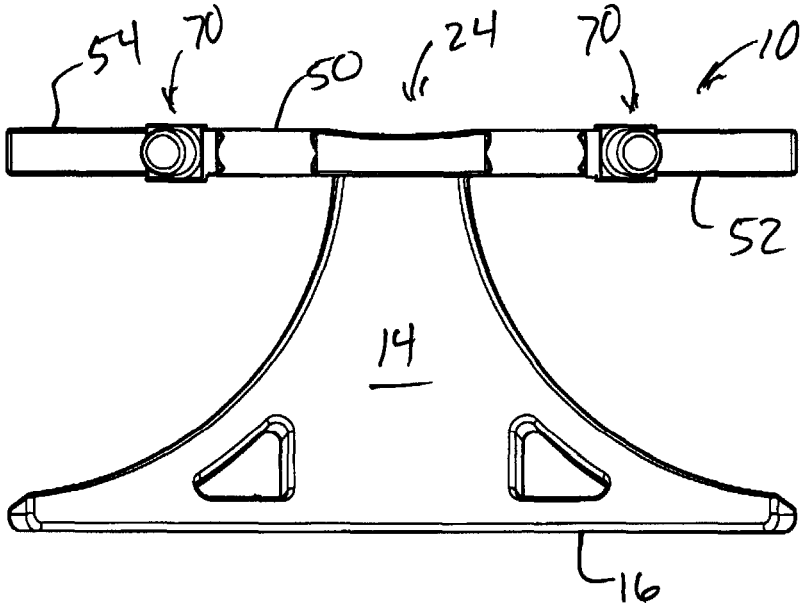
FIG. 5 is a front view of the one embodiment of the exercise apparatus.
Figure 6:
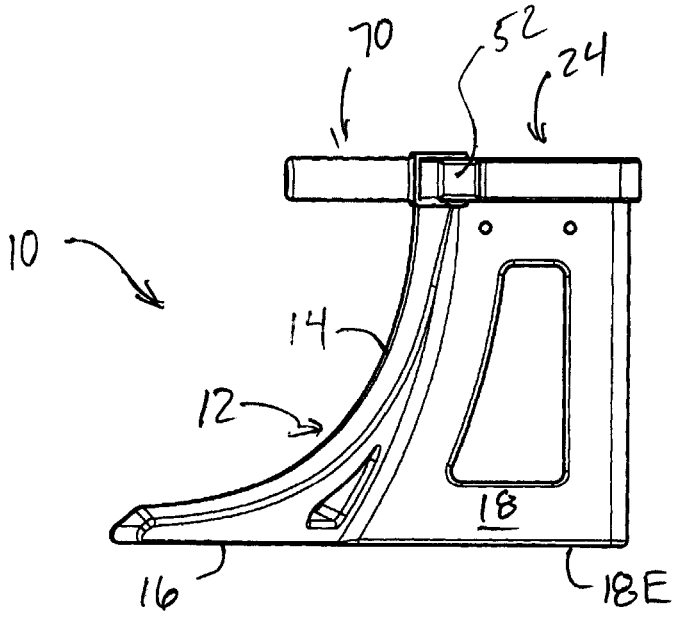
FIG. 6 is a side view of the one embodiment of the exercise apparatus.

As can be best seen in FIGS. 1, 2 and 4, first and second handle support portions 52 and 54 of handlebar 50 extend laterally away from the forward end of seat rest 24 in a bilateral fashion. As can be seen by referring to FIGS. 4 and 6, handlebar 50, in this example, is continuous bar which is fixed inside the forward end of seat rest 24. As can be seen in FIGS. 4 and 6, in this example, handlebar 50 is bowed so that it describes a curve having a center of curvature which is generally in the same plane as seat rest 24 and which is located behind seat rest 24. In this example, handlebar 50 has a radius of curvature which is between three and four times the length of the bar. It is also possible to reverse the orientation of handlebar 50 so that the location of the center of curvature is on the opposite side of exercise apparatus 10. Still further, it is also possible to form handlebar 50 so that it has little or no curvature. Preferably, handlebar 50, in order to accommodate a wide range of adult exercisers, should have a total length between approximately 24 and 36 inches as measured between the opposite outboard ends of handle support portions 52 and 54. As can be seen in FIGS. 1-6, handle support portions 52 and 54 occupy more than one half of the portion of handlebar 50 which extends from either side of seat rest 24. As can be seen in FIGS. 1-3, handle support portions 52 and 54 present square cross sections, which in this example, are oriented to present horizontal upper and lower surfaces and vertical side surfaces. Although a square cross section has been selected for handle support portions 52 and 54 for this example, any one of a number of regular polygons could be selected for the cross section of handle support portions 52 and 54.

Figure 7:
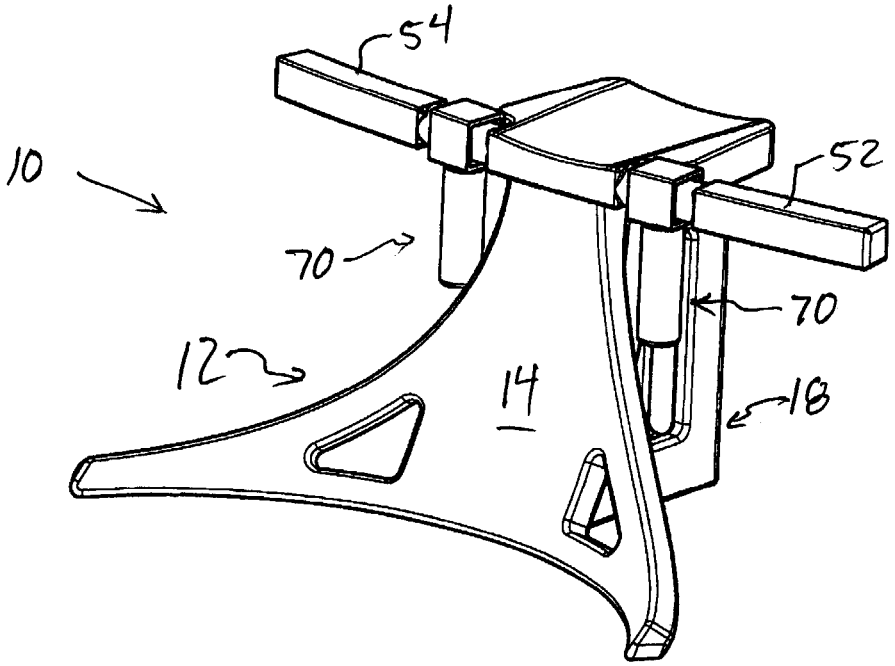
FIG. 7 is a perspective view of the one embodiment of the exercise apparatus showing the handles in an inboard, stowed position.

As can be best seen in FIGS. 1, 2 and 4, handles 70 each include a handle portion 72 and mounting portion 74. Handle portion 72 is generally cylindrical in shape and is adapted for grasping by a human hand from differing directions and from different positions. Handle portion 72 is also preferably padded for comfort. Mounting portion 74 is fixed at one end of handle portion 72. In this example, mounting portion 74 presents an opening 76 which, in this example is square and which is oriented normally in relation to handle portion 72. Opening 76 is shaped and sized to receive one of handle support portions 52 or 54. Thus, it is possible to mount a handle 70 on one of handle support portions 52 or 54 in one of at least four positions, namely, with handle portion 72 directed up, directed forward, directed backward and directed down. It is also possible to mount a handle 70 in any one of these positions between an inboard position and an outboard position. Still further, as shown in FIG. 7, it is possible to stow handles 70 in an inboard hanging position. These various adjustments in terms of orientation and spacing make it possible to accommodate a wide range of exercises and to also accommodate exercisers having a wide range of body sizes.

By way of example, various exercises may be executed by an exerciser using apparatus 10. By placing handles 70 in the forward horizontal position shown in FIG. 1, an exerciser may grasp the handles, place his or her feet so that they are spaced away from and opposite from curved plate 14 and execute push-ups. Handles 70 may also be placed in the stowed position shown in FIG. 7 while the exerciser executes push-ups with his or her palms being supported by upper flat surfaces of handle support portions 52 and 54. The exerciser could also execute "bar-dips" by grasping handles 70 when they are in the forward position shown in FIG. 1 with the exerciser's back adjacent to seat rest 24 and the exercisers feet positioned away from curved plate 14. Still further, the exerciser may exercise abdominal muscles by sitting on seat rest 24 with feet positioned forward and away from curved plate 14, by positioning handles 70 so that they are oriented in an upward orientation, grasping handles 70 and either extending the legs or raising and lowering the upper body, or both. Other exercises may also be possible using exercise apparatus 10.

As can be understood from the above description, exercise apparatus 10 will accommodate an exerciser in wide variety of exercise positions and will also accommodate exercisers having a wide range of body sizes. Moreover, exercise apparatus 10 is relatively compact and may even be arranged so that it may be disassembled for storage in a limited space.

Figure 8:
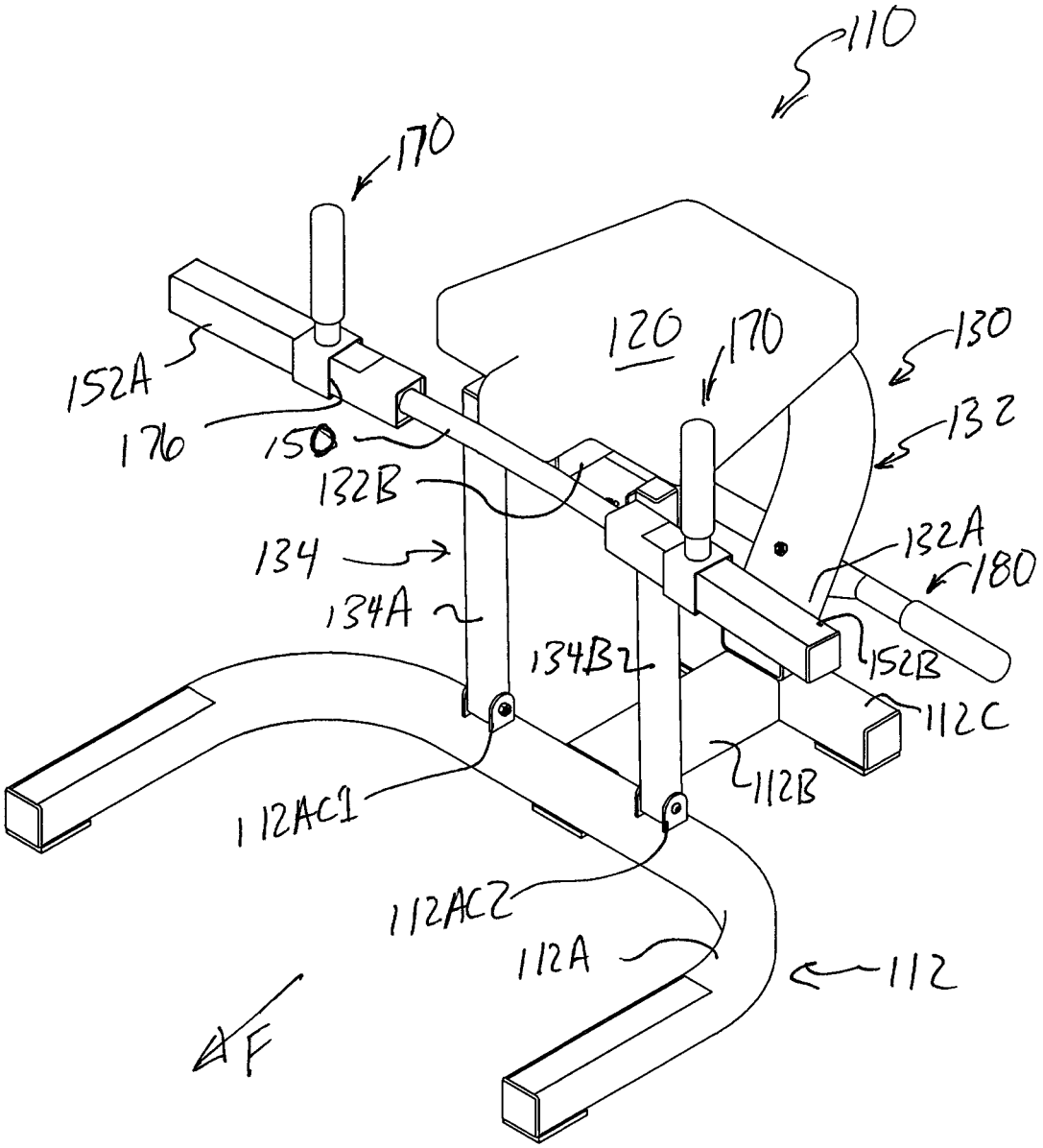
FIG. 8 is a first perspective view of a second embodiment of the exercise apparatus.
Figure 9:
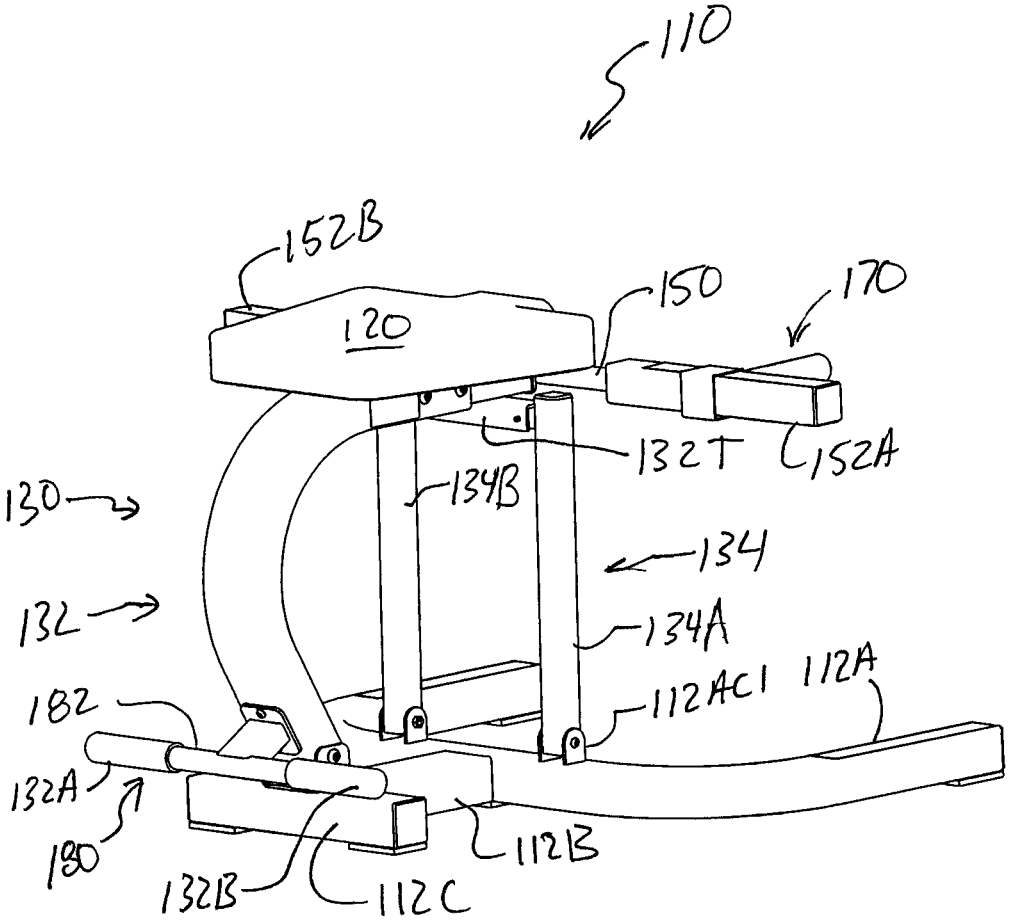
FIG. 9 is a second perspective view of the second embodiment of the exercise apparatus.

FIGS. 8-12 illustrate a second embodiment exercise apparatus 110. As can be seen in FIGS. 8 and 9, exercise apparatus 110 includes a base 112, a seat rest 120, a seat support assembly 130, a handle support assembly 150 which carries first and second handles 170 and a foot bar assembly 180. In this example, seat support assembly 130 includes a first seat support structure 132 and a second seat support structure 134. A direction arrow F in FIG. 8 indicates a forward direction which may be referred to in the description below.

Figure 10:
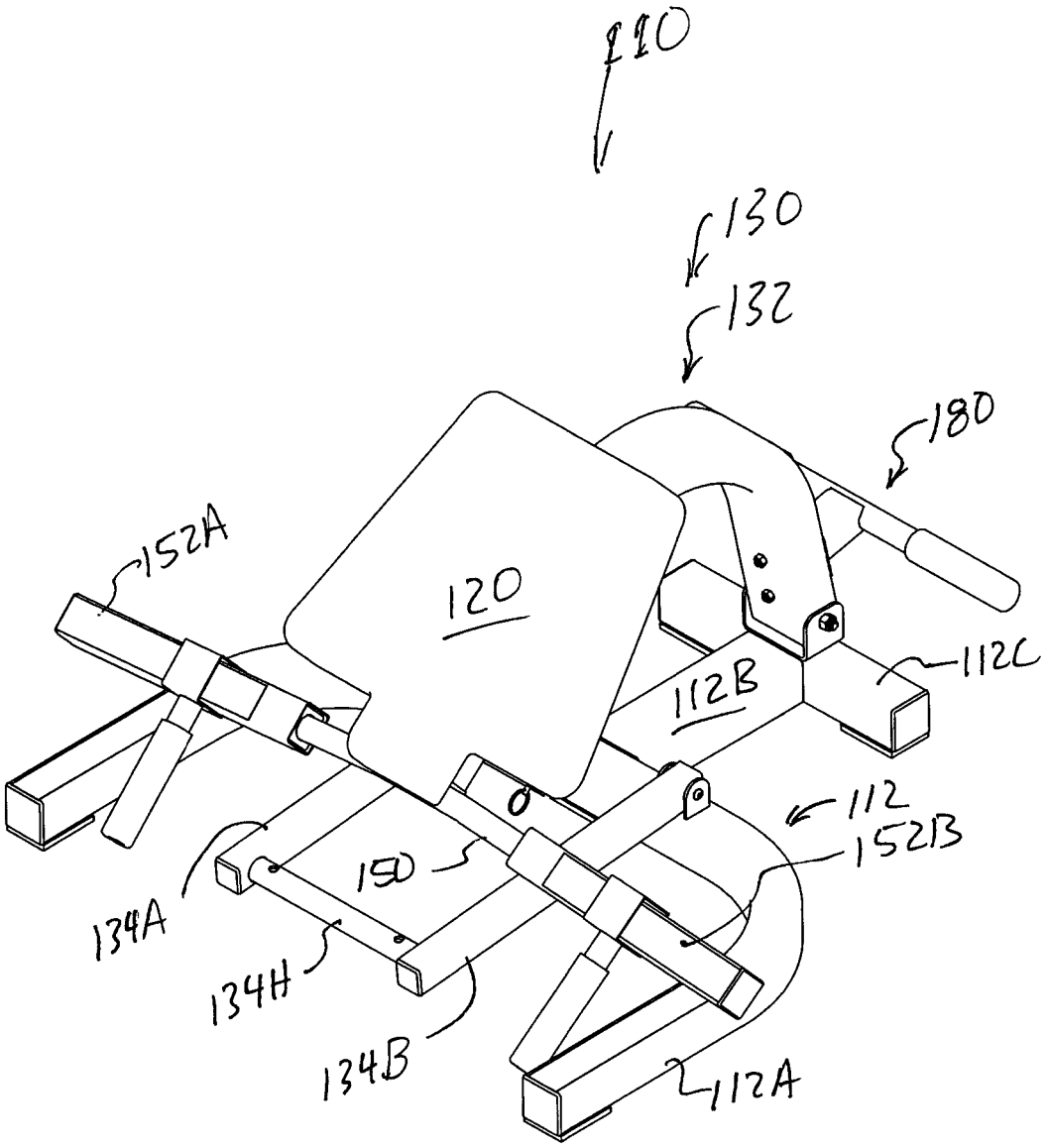
FIG. 10 is a third perspective view of the second embodiment of the exercise apparatus shown in a folded position.
Figure 11:
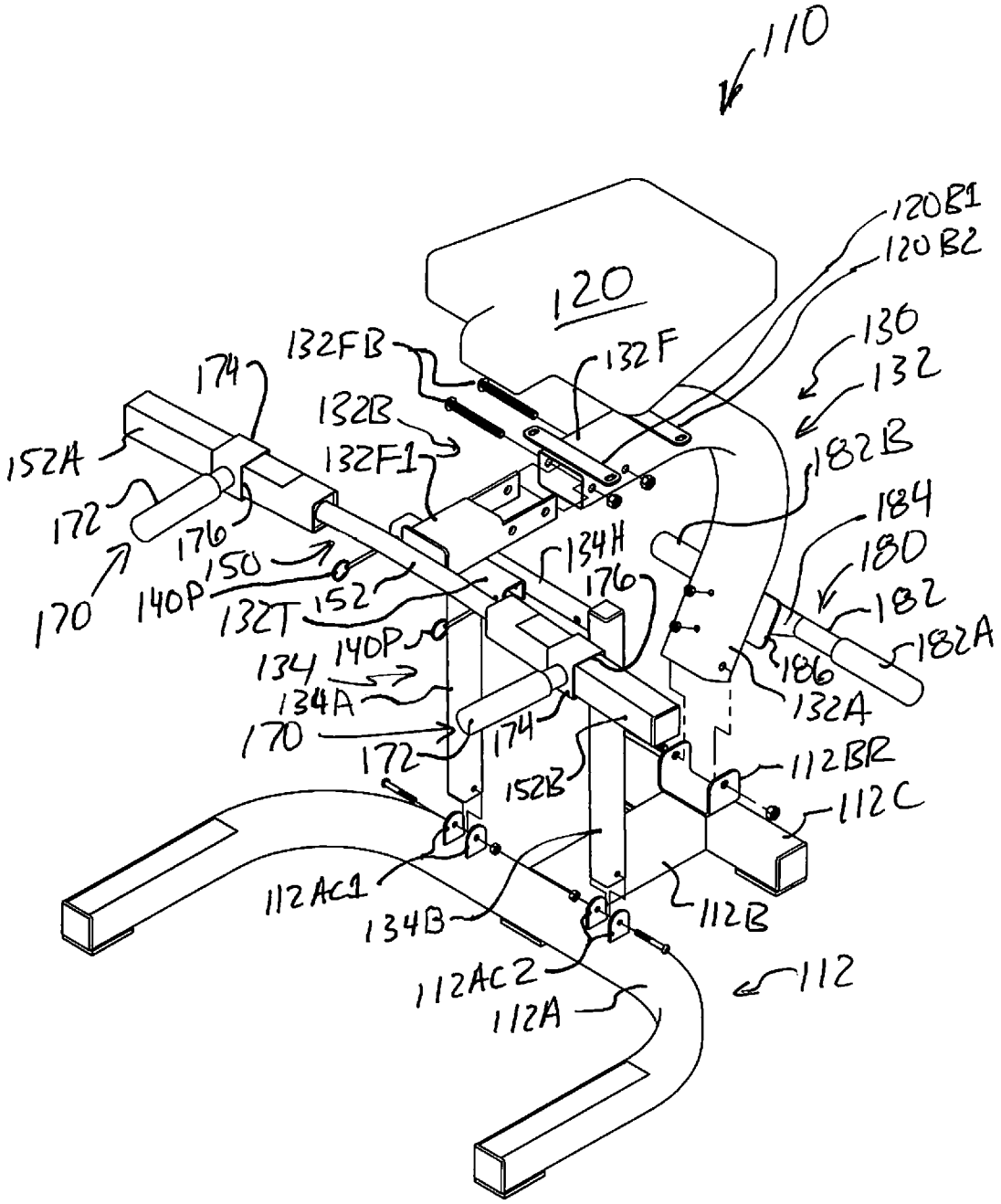
FIG. 11 is fourth perspective view of the second embodiment of the exercise apparatus shown exploded.
Figure 12:
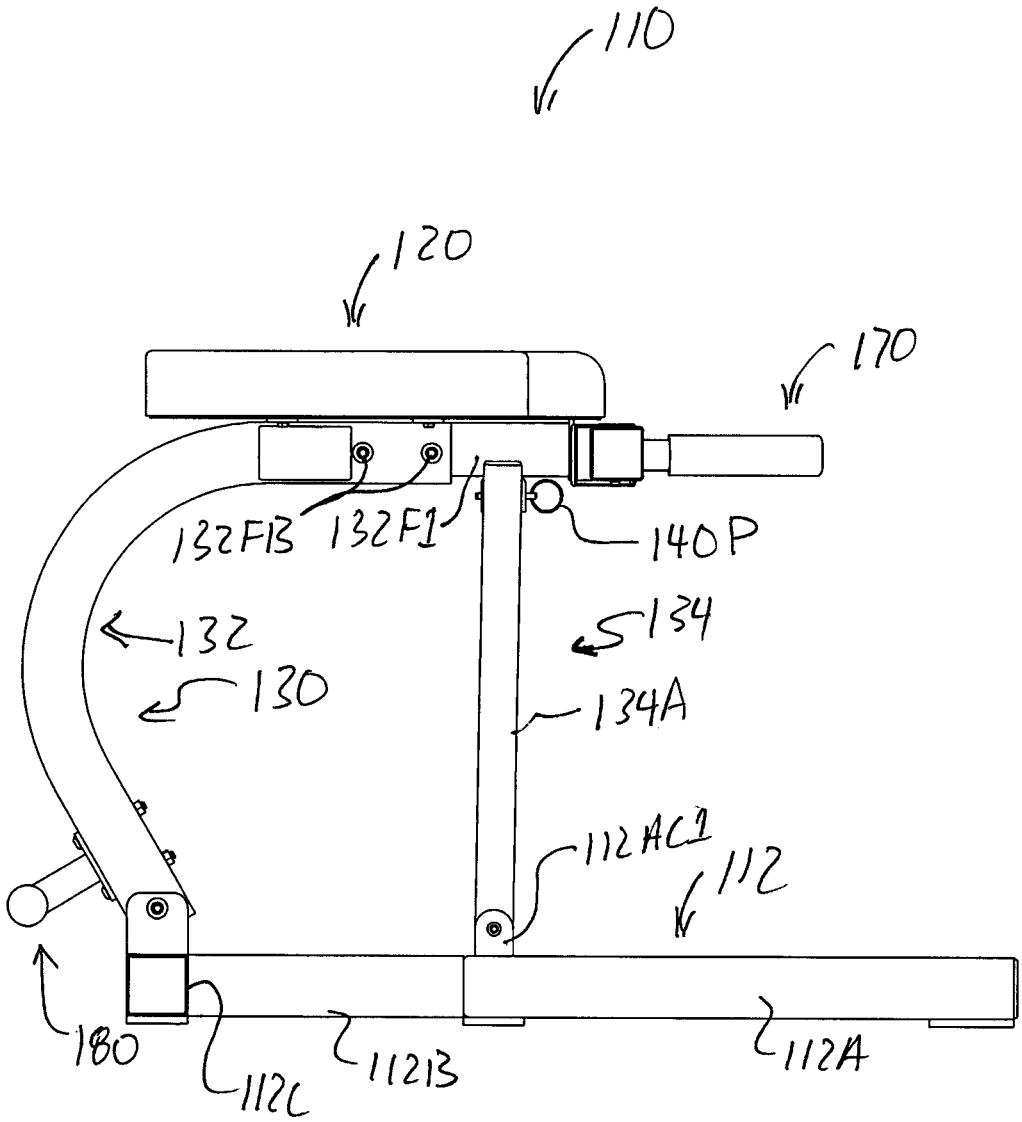
FIG. 12 is side view of the second embodiment of the exercise apparatus.

As can be seen in FIGS. 8-12, base 112 is fashioned from a U shaped forward portion 112A and longitudinally extending rear portion 112B. A cross support portion 112C is fixed to the distal end of extending rear portion 112B. In this example, rear portion 112B is welded to forward portion 112A and cross support portion is welded to the distal end of extending rear portion 112B As can be seen in FIGS. 8-10, in this second embodiment, first seat support structure 132 has a first end 132A and a second end 132B. First seat support structure 132 is a curved member. First seat support structure 132 is pivotably mounted at its first end 132A to a bracket 112BR which is fixed to the cross piece portion 112C of base 112 at a location which is adjacent rear portion 112B of base 112. First seat support structure 132 is able to move between a first folded storage position as shown in FIG. 10 and a second extended position as shown in FIGS. 8, 9 and 12. Second end 132B of first seat support structure 132 presents a flat portion 132F which supports seat rest 120. In this example, flat portion 132F includes a removable portion 132F1 which is arranged to be fastened to the remainder of flat portion 132F as is shown in FIG. 11. This arrangement facilitates the disassembly, storage or transport of exercise apparatus 110. This is particularly important since, as will be also noted below, handle support bar 150 is fixed to the end of removable portion 132F1. A transverse channel 132T is also fixed to the underside of removable portion 132F1 of first seat support structure. In this example, transverse channel 132T is parallel to handlebar 152 and is may be spaced closely to handlebar 152 as shown in FIG. 11.

Second seat support structure 134 is pivotably mounted to forward portion 112A of base 112 for movement between a first folded position shown in FIG. 10 and a second raised operating position shown in FIGS. 8, 9 and 12. Second seat support structure, in this example, includes two upright support members 134A and 134B which are connected at their distal ends by a horizontal support member 134H. Upright support members 134A and 134B are fixed to forward portion 112A of base 112 at two devises 112AC1 and 112AC2 which spaced from rear portion 112B of base 112. A transverse channel 132T is fixed to the underside of removable portion 132F1 of second end 132B of first seat support structure 132. Transverse channel 132T is adapted to receive upper horizontal member 134H of second seat support structure 134. In this example, a pair of pins 140P are inserted through corresponding holes in transverse channel 132T and horizontal member 134H in order to securely fix first and second seat support structure 132 and 134 together. Thus, when both first seat support structure 132 and second seat support structure 134 are positioned and fixed together as shown in FIGS. 8 and 9 in the second raised, operating position, channel 140 of first seat support structure 132 receives upper horizontal member 134H of first seat support structure 132 and is secured thereto by pins 140P as described above, first seat support structure 132 and second seat support structure 134 are secured in the second raised, operating position as shown in FIGS. 8, 9 and 12.

As can be best seen in FIG. 8, handle support assembly 150 is generally horizontal and is fixed to the distal end of removable portion 132F1 of second end 132B of first seat support structure 132. As is shown in FIGS. 8-10, handle support assembly 150 includes a transverse handlebar 152 which extends laterally and horizontally from removable portion 132F1 of second end 132B of first seat support member 132. Preferably, handlebar 152 is also bowed slightly forward and away from seat rest 120. Preferably, handlebar 152 is bowed so that lines which are normal to the outboard ends of handle support assembly 150 may intersect at a point which is spaced away from handlebar 152 in the forward direction (indicated by arrow F in FIG. 8) by a distance that may be preferably between three or four times the length of handlebar 152 or at least not less than two times the length of handlebar 152 or optionally not more than five times the length of handlebar 152.

As can be best seen in FIGS. 8-10, handlebar 152 of handle support assembly 150 presents two opposite end portions 152A and 152B, which, in this example, present square cross sections. (Although, any regular polygon having a reasonable number of equal sides with perhaps no more than eight sides could be selected for the cross section shape of opposite end portions 152A and 152B.) End portions 152A and 152B are suitable for receiving handles 170 as will be described in more detail below.

As can be seen in FIGS. 8-10, as was the case for first embodiment exercise apparatus 10 handles 170 of exercise apparatus 110 each include a handle portion 172 and a mounting portion 174. In this example, handle portion 172 is generally cylindrical and is preferably padded for comfort when grasped by the hand of an exerciser. Mounting portion 174 is fixed at one end of handle portion 172. In this example, mounting portion 174 presents an opening 176 which, in this example is square and which is oriented normally in relation to handle portion 172. Accordingly, each opening 176 of each mounting portion 174 of each handle 170, in this example, presents a square opening which is suitable for receiving one of each of the opposite end portions 152A or 152B which are correspondingly square shaped. (Or, each opening 176 could have the shape of another regular polygon that would register with a corresponding regular polygon selected for opposite end portions 152A and 152B.) Thus, it is possible to mount a handle 170 on one of handle support portions 152A or 152B in one of at least four positions, namely, with handle portion 172 directed up, directed forward, directed backward and directed down. Because, in this example, opposite end portions 152A and 152B extend laterally between in inboard end and an outboard end, it is also possible to mount a handle 170 in any one of these positions between an inboard position and an outboard position. Still further, as shown in FIG. 7 for exercise apparatus 10, it would also be possible to stow handles 170 in an inboard hanging position so that the handles are hanging on handle support bar 150 at locations which are inboard of opposite end portions 152A and 152B. These various adjustments in terms of orientation and spacing make it possible to accommodate a wide range of exercises and to also accommodate exercisers having a wide range of body sizes.

As can be best seen in FIG. 9, in this example, a foot bar assembly 180 is fixed to first end 132A of first seat support member 132. As can be seen in FIG. 9, foot bar assembly 180 includes a transverse foot bar 182 which is fixed to a mounting bar 184. Mounting bar 184, in turn, presents a mounting plate 186 at its proximal end. Mounting plate 186, in this example, presents a pattern of fastener holes which match corresponding fastener holes in first end 132A of first seat support structure 132. Suitable fasteners are inserted through the corresponding fastener holes in order to fix foot bar assembly to first seat support structure 132 as is shown in FIG. 11. Transverse foot bar 182 extends laterally and presents two padded portions 180A which are suitable for receiving pressure from the feet of an exerciser. Preferably, as is the case in this example, transverse foot bar 182 of foot bar assembly 180 is spaced away diagonally from handle support assembly 150 and is preferably generally parallel to handlebar 152. Transverse foot bar 182 is particularly suited for receiving pressure from the insteps of the feet to facilitate abdominal exercises.

As can be seen in FIG. 11, in this example, exercise apparatus 110 is arranged so that it is able to be disassembled for storage and transport. As can be seen in FIG. 11, handle support assembly 150 is fixed to a handle support member 124F1 which is slidably received by flat portion 132F of first seat support member 130. A pair of fasteners 124FB secure handle support member 124F1 to flat portion 132F. As can be seen in FIG. 11, seat rest 120 may also be removably fastened to flat portion 132F of first seat support structure 132. Still further, as noted above, because handlebar 152 and transverse channel 134T are fixed to removable portion 132F1 of first seat support structure 132, handlebar 152 and transverse channel 134T are able to be disassembled from seat support structure 132 for storage and transport. Yet still further, because fasteners are used to mount foot bar assembly 180 to first seat support structure 132 it is also possible to remove detach foot bar assembly 180 to facilitate storage and transport. Thus, as can be seen in FIG. 11, it is possible to break down exercise apparatus 110 such that it is possible to arrange all of the components of exercise apparatus 110 in a relatively compact space which may even have a low profile.

Exercise apparatus 110 may be used for a number of exercises. For example, an exerciser may seat himself or herself on seat rest 120 with the back of the exerciser oriented toward the forward direction F (as indicated in FIG. 8). The exerciser may then position his or her feet under either side of foot bar 180 so that the insteps of the feet engage foot bar 180. The exerciser may then lower his or her upper body toward the forward direction F and then raise the upper body in order to exercise the abdominal or core muscles. Another example exercise may be executed by grasping handles 172 with opposite hands while facing the forward direction F with the legs and feet extended toward the forward direction F and then dipping down and back up to exercise the muscles of the arms. Yet another example exercise may be executed by grasping handles 170 in a face down position with the legs and feet oriented in the forward direction F. With handles 172 in the position shown in FIG. 8, it is then possible to execute push-ups. A number of other exercises may also be executed using exercise apparatus 110.

Most of the structural components for exercise apparatus 110 described above, with the possible exception of the pads for handle portions 172 and foot bar 180 as well as seat rest 120, are preferably fashioned from steel tubing and steel stock. Preferably, many of the joints between various components of exercise apparatus 110 may be made by welding. Other joints may be made with fasteners in order to allow exercise apparatus 110 to be disassembled into a compact volume for easy storage or shipping.

It is to be understood that while certain forms of this invention have been illustrated and described, it is not limited thereto, except in so far as such limitations are included in the following claims and allowable equivalents thereof

Having thus described the invention, what is claimed as new and desired to be secured by Letters Patent is:

1. An exercise apparatus, comprising:

(a) a base;

(b) a first seat support structure having a first end and a second end, the first seat support structure being pivotably mounted to the base at the first end for movement between a first folded position for the first seat support structure and a second raised, operating position for the first seat support structure;

(c) a seat rest fixed to the second end of the first seat support structure;

(d) a second seat support structure that is pivotably mounted to the base for movement between a first folded position for the second seat support structure and a second raised, operating position for the second seat support structure;

(e) the first seat support structure and the second seat support structure being arranged so that the first seat support structure and the second seat support structure are able to be secured to each other when the first seat support structure is in the second raised, operating position for the first seat support structure and the second seat support structure is in the second raised, operating position for the second seat support structure;

(f) a handle support assembly mounted to the second end of the first seat support structure, the handle support assembly presenting regular polygonal end portions; and, (g) a pair of handles that each include a mounting portion, the mounting portion of each handle presenting an opening in the shape of a regular polygon that is adapted to receive one of the regular polygonal end portions of the handle support assembly, each of the handles being securable to one of the regular polygonal end portions of the handle support assembly in one of a range of locations between an inboard location and an outboard location, and each of the handles being securable to one of the regular polygonal end portions of the handle support assembly in one of at least two angular orientations.

2. The exercise apparatus of claim 1, further comprising:

a foot bar that is secured to the first seat support structure.

3. The exercise apparatus of claim 1, further comprising:

a foot bar that is secured to the first seat support structure, the foot bar being spaced diagonally from the handle support bar and being generally parallel to the handle support bar.

4. The exercise apparatus of claim 1, wherein:

the handle support assembly is bowed slightly in a direction that is forward and away from the seat rest.

5. The exercise apparatus of claim 1, wherein:

the handle support assembly is bowed slightly in a direction that is forward and away from the seat rest such that lines normal to the regular polygonal end portions of the handle support assembly would intersect in the direction that is forward and away from the seat rest at a point that is spaced away from the handle support assembly by a distance that is between 2 and 5 times a length of the handle support assembly.

* * * * *